US005816887A

United States Patent [19]

Rudell et al.

[11] Patent Number: 5,816,887

[45] **Date of Patent: *Oct. 6, 1998**

[54] RADIO CONTROLLED TOY WITH REMOTE ACCESSORY ACTIVATION

[75] Inventors: Elliot Rudell, Torrance; George Foster, Signal Hill, both of Calif.

[73] Assignee: Elliot A. Rudell, Torrance, Calif.

[ * ] Notice: This patent issued on a continued prosecution application filed under 37 CFR 1.53(d), and is subject to the twenty year patent term provisions of 35 U.S.C. 154(a)(2).

[21] Appl. No.: 570,667

[22] Filed: Dec. 11, 1995

[51] Int. Cl.[6] ..... A63H 17/00; A63H 19/24

[52] U.S. Cl. ..... 446/456; 446/427; 446/433

[58] Field of Search ..... 446/175, 424, 446/427, 441, 454–456, 446, 447, 436, 462, 478, 4, 6, 290, 433

[56] References Cited

U.S. PATENT DOCUMENTS

| | | | |
|---|---|---|---|
| 2,254,063 | 8/1941 | Drake | 446/427 X |
| 3,199,249 | 8/1965 | Carver et al. | 446/290 |
| 4,488,373 | 12/1984 | Glickson et al. | 446/4 |
| 4,854,909 | 8/1989 | Ishimoto | 446/456 X |
| 5,131,881 | 7/1992 | Okada | 446/424 |

*Primary Examiner*—John A. Ricci

*Attorney, Agent, or Firm*—Blakely Sokoloff Taylor & Zafman

[57] ABSTRACT

A remotely controlled vehicle that mechanically activates an action accessory. The vehicle contains a remotely controlled plunger that engages a trigger of the action accessory. Engaging the trigger activates a mechanism within the action accessory. Activation of the mechanism induces a mechanical action such as ejecting a projectile or loading items onto the vehicle. The plunger and vehicle are remotely controlled by a transmitter which emits command signals to a receiver located within the vehicle. In operation, the end user skillfully manipulates the vehicle over the trigger and then transmits a command to extend the plunger and activate the mechanism of the action accessory.

17 Claims, 8 Drawing Sheets

RADIO CONTROLLED TOY WITH REMOTE ACCESSORY ACTIVATION

BACKGROUND OF THE INVENTION

1. Field of the Invention

The present invention relates to remotely controlled toy vehicles and action accessories that are mechanically activated by the vehicle.

2. Description of Related Art

There have been developed and sold toy vehicles which can be remotely controlled through a radio frequency (RF) transmitter. The transmitter typically contains a button or lever which can be manipulated by the operator to modulate a signal that is transmitted to a receiver located within the vehicle. The signal is demodulated by a controller located within the toy vehicle. The demodulated signal controls the direction and speed of the vehicle.

There have been marketed radio controlled toy vehicles by Tyco Toys under the trademarks FIREPOWER and PYTHON. The Tyco Toys each have a radio controlled accessory item mounted directly to a vehicle. The FIREPOWER product ejects a foam missile in response to an RF command. The PYTHON extends a mechanical element upward and emits a stream of water in response to a command. The commands that control the accessories are transmitted on a RF channel that is separate from the channel used to control the vehicle. Any additional accessories would require more RF channels. Multi-channel transmitters are relatively expensive to produce. It would therefore be desirable to provide a remotely controlled two channel toy vehicle that can activate a plurality of action accessories.

SUMMARY OF THE INVENTION

The present invention is a remotely controlled vehicle that mechanically activates an action accessory. The vehicle contains a remotely controlled plunger that engages a trigger of the action accessory. Engaging the trigger activates a mechanism within the action accessory. Activation of the mechanism induces a mechanical action such as ejecting a projectile or loading items onto the vehicle. The plunger and vehicle are remotely controlled by a transmitter which emits command signals to a receiver located within the vehicle. In operation, the end user skillfully manipulates the vehicle over the trigger and then transmits a command to extend the plunger and activate the mechanism of the action accessory.

BRIEF DESCRIPTION OF THE DRAWINGS

The objects and advantages of the present invention will become more readily apparent to those ordinarily skilled in the art after reviewing the following detailed description and accompanying drawings, wherein.

DETAILED DESCRIPTION OF THE INVENTION

Figures 1, 2:
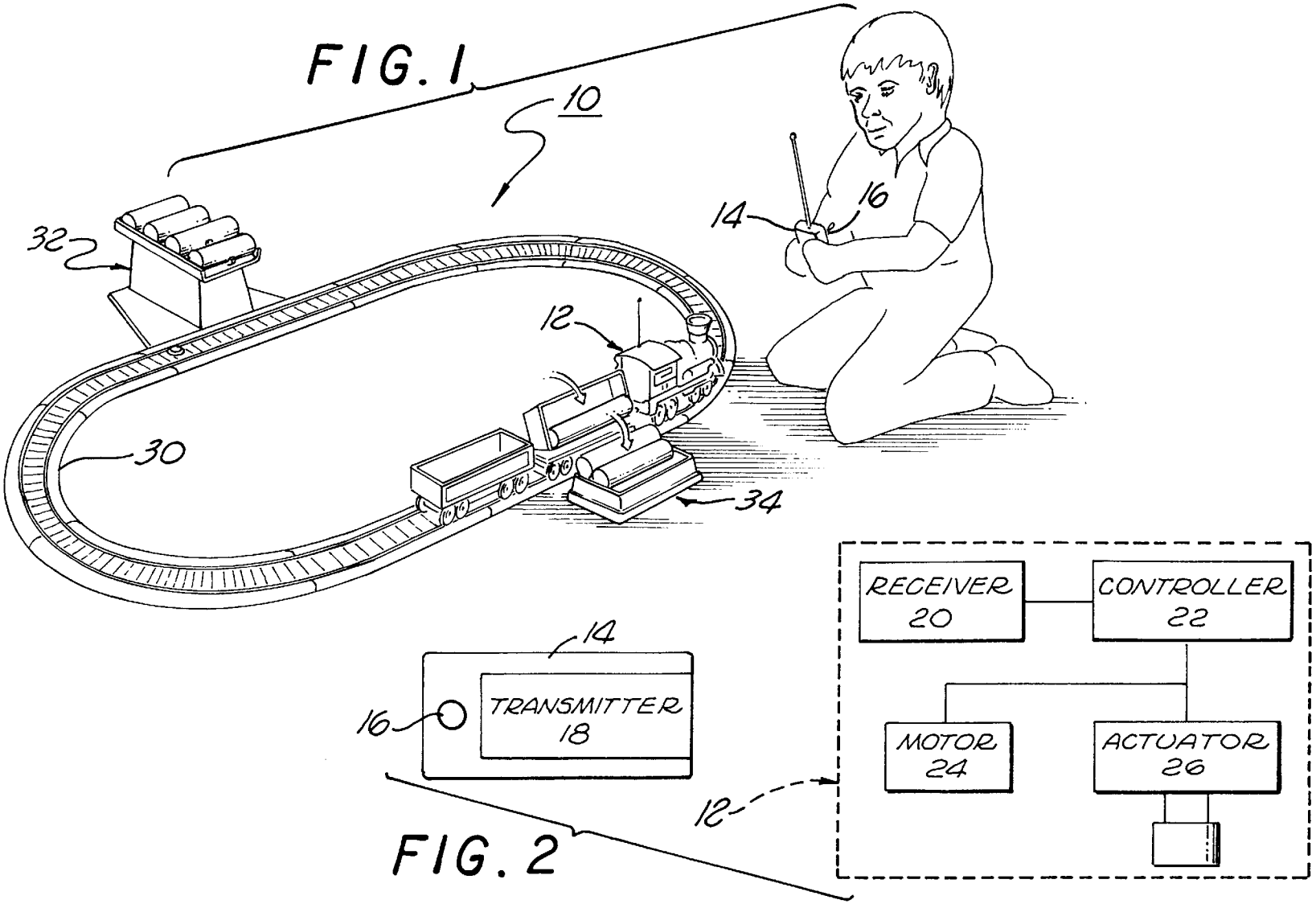
FIG. 1 is a perspective view of a toy set of the present invention.
FIG. 2 is a schematic of a control system for the toy set.

Referring to the drawings more particularly by reference numbers, FIG. 1 shows a toy set 10 of the present invention. The toy set 10 includes a vehicle 12 that is remotely controlled by an end user through a transmitter unit 14. The transmitter unit 14 has a lever and/or buttons 16 which can be manipulated by the end user to transmit control signals to the vehicle 12.

FIG. 2 shows a control system for the toy set 10. The system includes a transmitter 18 located within the unit 14. The transmitter 18 sends signals to a receiver 20 located within the vehicle 12. The signals may be modulated electrical signals operating in a radio frequency range. Alternatively, the transmitted signals may be in the infrared frequency range.

The receiver 20 is coupled to a motor controller 22 which controls the speed of a motor 24 that powers the vehicle 12. The receiver 20 is also coupled to an actuator 26. The actuator 26 may be a solenoid which moves a plunger 28 to an extended position. The transmitter 18 may have a lever button(s) which transmits a first signal to control the motor 24, and a separate lever or button that transmits a second signal which energizes the actuator 26. The first and second command signals are typically provided on separate communication channels. Although a plunger 28 is shown and described, it is to be understood that the vehicle 12 may have other mechanisms which can mechanically engage an external device.

Referring to FIG. 1, the vehicle 12 may be constructed as a toy train that moves about a circular track 30. The vehicle 12 and track 30 may have elements that guide the train 12 around the track 30 as is known in the art. The track 30 may be constructed as individual pieces which are assembled by the end user onto a playing surface. The train set may have a loading station 32 and an unloading station 34.

Figure 3A:
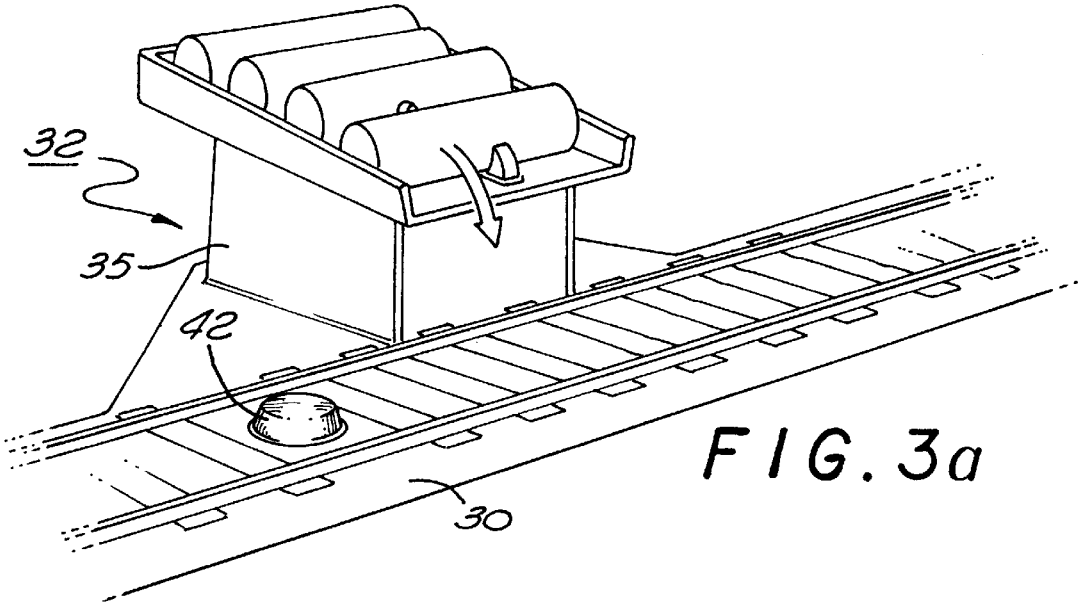
FIG. 3*a* is an enlarged perspective view showing a trigger activated accessory item.

As shown in FIG. 3*a,* the loading station 32 includes an action accessory 35. The accessory 35 has a plurality of individual toy barrels 36 located on a ramp 38. The barrels 36 are held in place by a lever mechanism 40. The lever mechanism 40 is coupled to a trigger 42 located within the track 30. The lever 40 is moved into a downward direction when the trigger 42 is depressed.

Figure 3B:
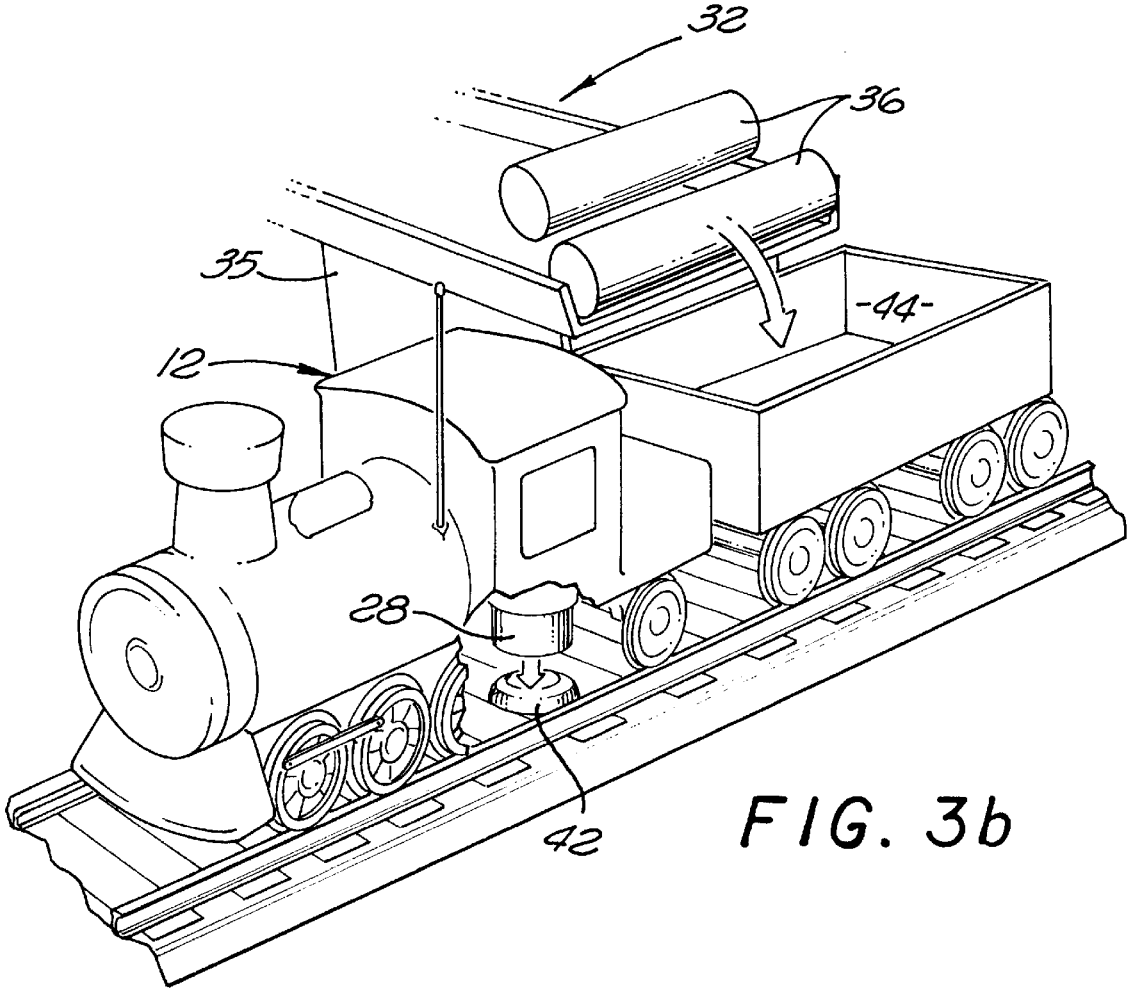
FIG. 3*b* is an enlarged perspective view showing a train plunger engaging the trigger of the accessory item.

As shown in FIG. 3*b,* the end user manipulates the transmitter to move the train 12 in front of the loading station 32. When the plunger 28 is aligned with the trigger 42, the end user transmits a command signal to energize the actuator 26. Energizing the actuator 26 extends the plunger 28 into the trigger 42. The depression of the trigger 42 lowers the lever 40 and allows the toy barrels 36 to fall into a container compartment 44 of the train 12.

When the command signal is terminated, the plunger 28 disengages from the trigger 42 and returns to the original position. The actuator 26 typically has a spring return that moves the plunger 28 to the original position when power is terminated to the solenoid.

Figure 4A:
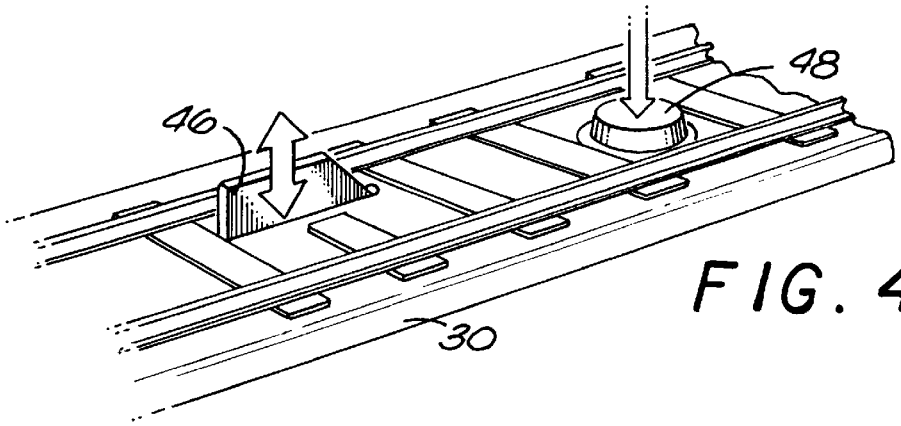
FIG. 4*a* is an enlarged perspective view showing a second trigger for the toy set.
Figure 4B:
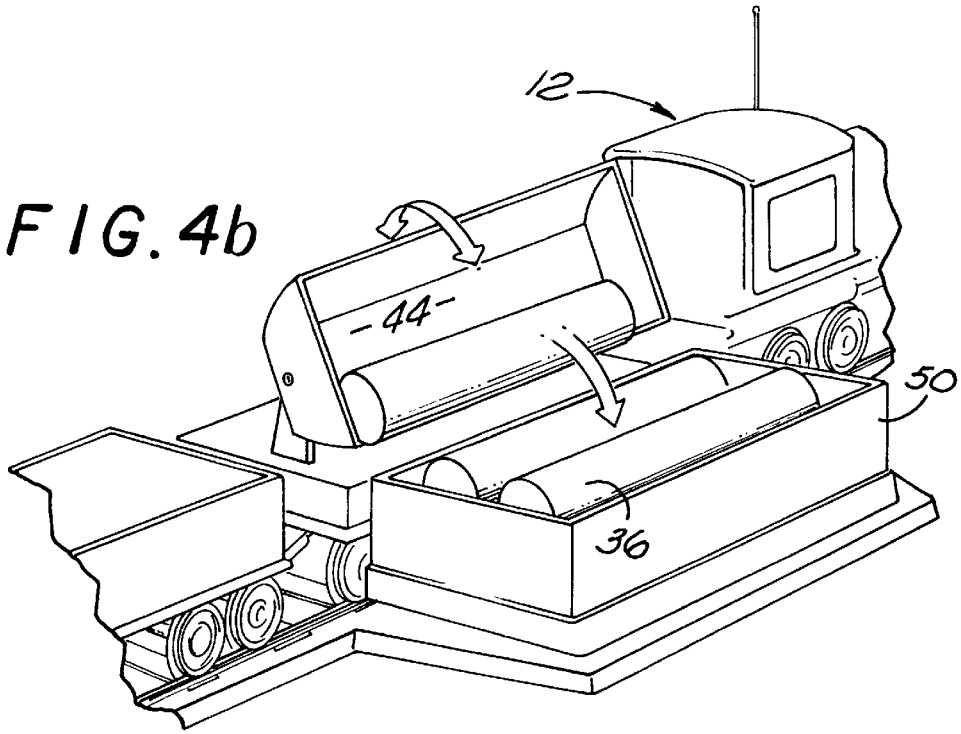
FIG. 4*b* is an enlarged perspective view showing the train unloading toy barrels into a toy bin.

FIG. 4*a* shows an unload lever 46 and a latch button 48 that are located on the track 30 and adjacent to the unloading station 34 shown in FIG. 1. Depressing the button 48 moves the lever 46 into an upward loaded position. As shown in FIG. 4*b* when the train 12 moves into the unloading station 34, the lever 46 engages a cam mechanism (not shown) which tilts the container compartment 44 of the train and rolls the toy barrels 36 into a bin 50. The engagement of the vehicle with the unload lever 46 moves the lever 46 down into a lower position. The lever 46 may be reset by depressing the button 48.

Figure 5A:
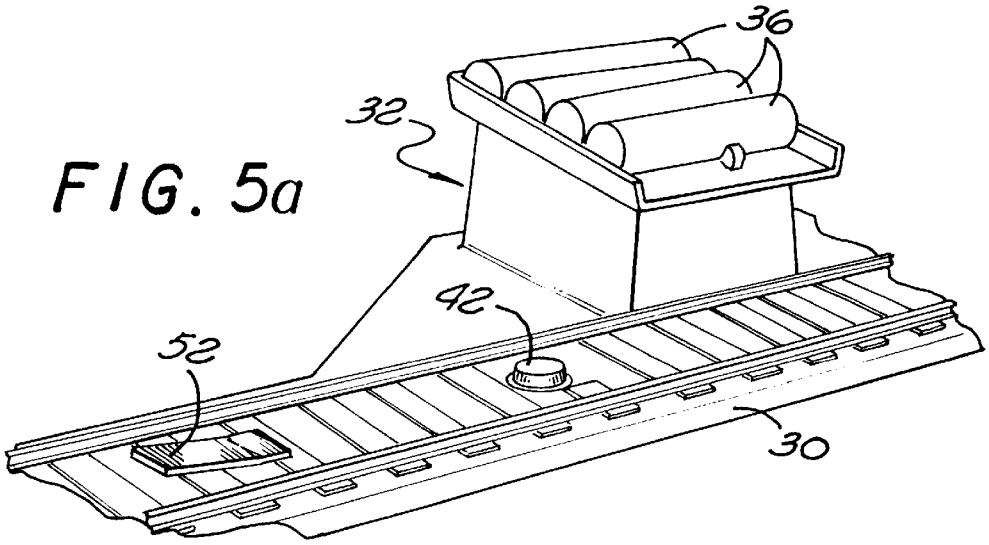
FIG. 5*a* is a perspective view showing a flexible alignment tab of the toy set.
Figure 5B:
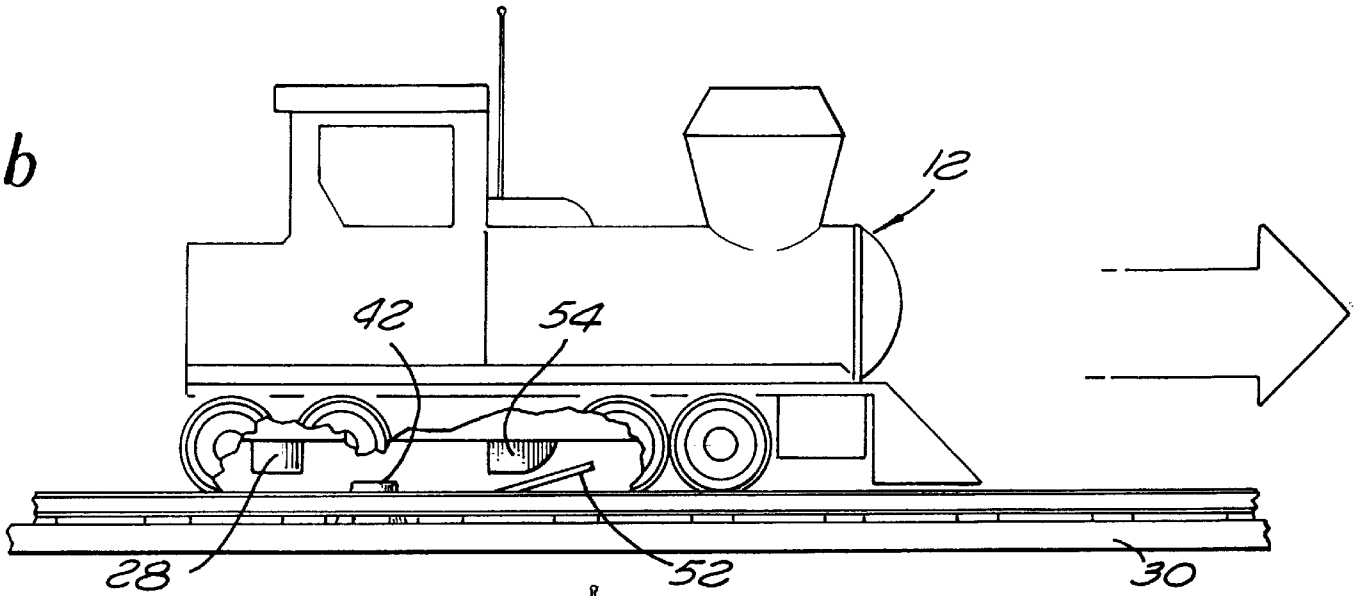
FIG. 5*b* is a side view showing a toy train moving across the flexible tab.
Figure 5C:
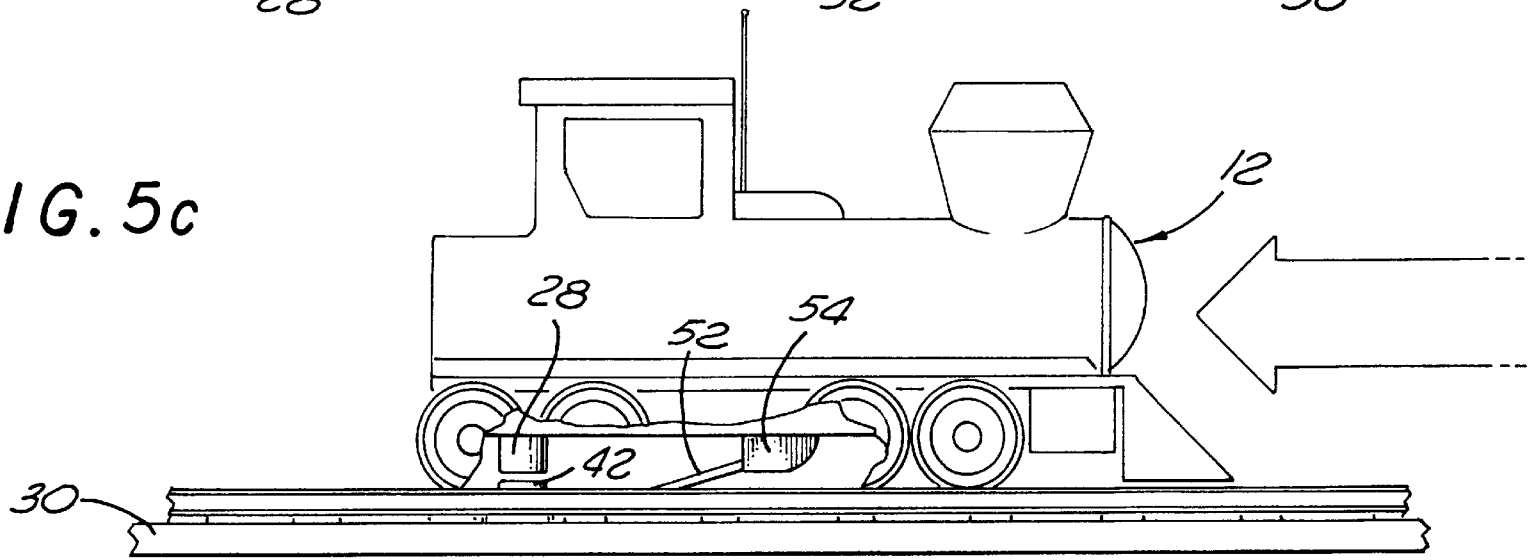
FIG. 5*c* is a side view similar to FIG. 5 showing the train moving in a reverse direction.

As shown in FIGS. 5*a–c* the loading station 32 may further include a flexible alignment tab 52 that aligns the plunger 28 of the train 12 with the trigger 42. The train 12 may have a locator 54 which moves over the flexible tab 52 when moving in a first direction. When the direction of the train 12 is reversed, the locator 54 engages the tab 52 and prevents further train motion, so that the plunger 28 is located above the trigger 42. The locator 54 and tab 52 allows the end user to more readily align the plunger 28 with the trigger 42 and load the toy barrels 36 into the container compartment 44 of the train.

Figure 6:
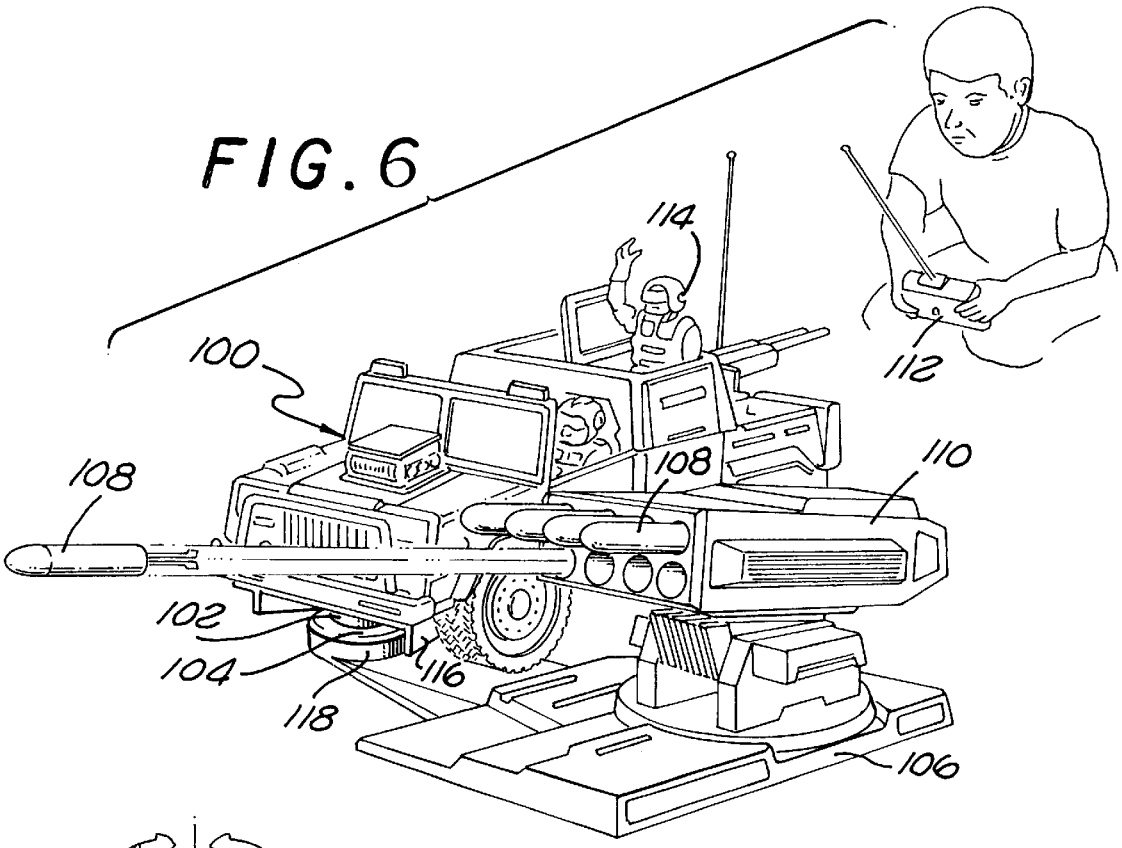
FIG. 6 is a perspective view of an alternate embodiment of the toy set.

FIG. 6 shows an alternate embodiment of the toy set. The toy set includes a remotely controlled vehicle 100 which has a plunger 102 that can depress a trigger 104 of an action accessory 106. The action accessory 106 contains a plurality of toy missiles 108 which are ejected from a toy launcher 110 when the plunger 102 depresses the trigger 104. The launcher 110 may contain a mechanical or electrical selector which sequentially fires the missiles after each depression of the trigger 104.

The toy set can be operated through a remote transmitter unit 112 held and manipulated by the end user. The transmitter 112 sends signals to a receiver located within the vehicle 100. The transmitted signals control the speed and direction of the vehicle. Additionally, the transmitted signals can activate the plunger 102 and depress the trigger 104. The vehicle 100 may contain an action figure 114 that moves to an up position when the plunger 102 is activated by the transmitter 112. The transmitter 112 may contain three separate channels that control the vehicle speed, vehicle direction, and the plunger, respectively.

There may be a V-shaped guide channel 116 located along the bottom of the vehicle 100. The guide channel 116 cooperates with an outer annular rim 118 of the trigger 104 to guide the vehicle 100 and align the plunger 102 with the trigger 104.

Figure 7:
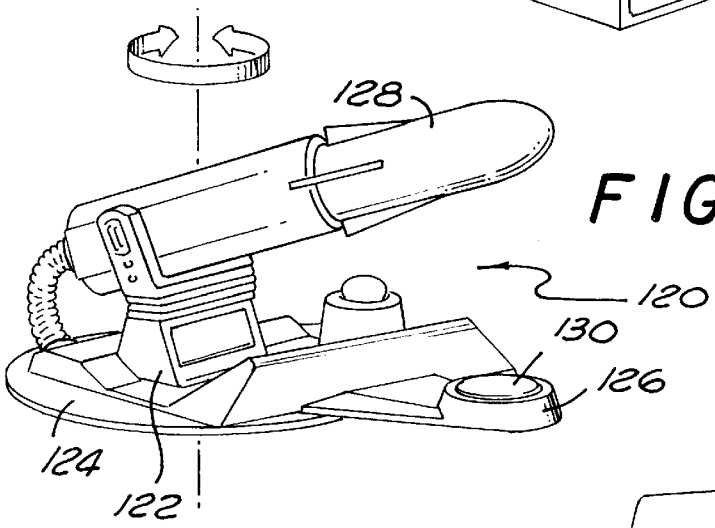
FIG. 7 is a perspective view of an alternate embodiment of an action accessory.

FIG. 7 shows an alternate embodiment of an action accessory 120 which has a toy missile launcher 122 that can be rotated about a base 124. When the vehicle 100 moves adjacent to the accessory 120, the guide channel 116 exerts a force on the outer trigger rim 126 and rotates the missile launcher 122 relative to the base 124. The launcher 122 ejects a toy missile 128 when the trigger 130 is depressed by the plunger 102 of the vehicle 100.

Figure 8:
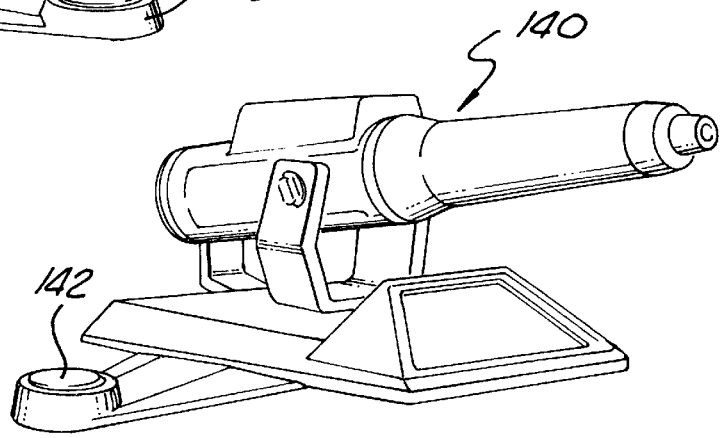
FIG. 8 is a perspective view of an alternate embodiment of an action accessory.

FIG. 8 shows an another action accessory 140 which emits a stream of fluid when the trigger 142 is depressed by the plunger 102 of the vehicle 100. The accessory 140 may be molded as a toy cannon which contains a reservoir that can be filled with water.

Figure 9A:
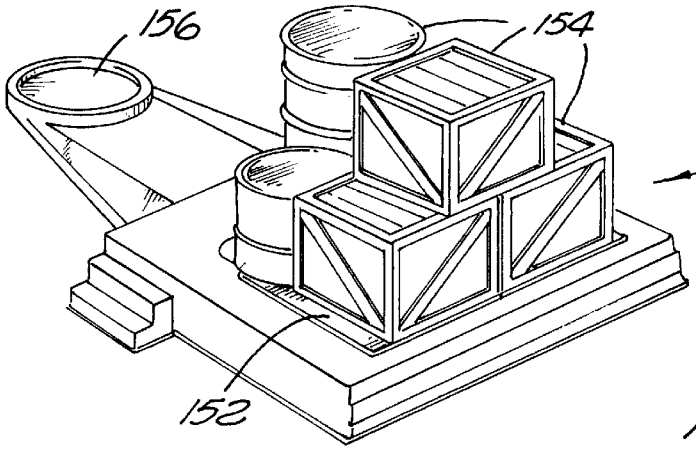
FIG. 9*a* is a perspective view of an alternate embodiment of an action accessory.
Figure 9B:
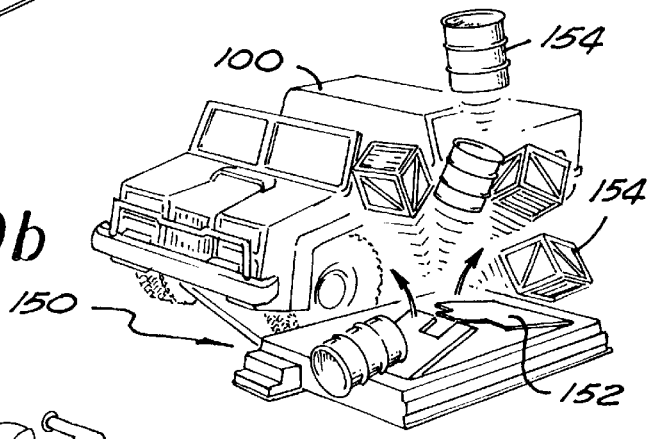
FIG. 9*b* is a perspective view of the action accessory of FIG. 9*a* after a mechanism of the accessory has been activated.

FIGS. 9*a* and 9*b* show an alternate action accessory 150 which has a platform mechanism 152 that projects a plurality of toy cargo containers 154 when the trigger 156 is depressed by the plunger 102 of a vehicle 100. The action accessory 150 provides the appearance of blowing up the containers 154 when the vehicle 100 is in alignment with the accessory 150.

Figure 10A:
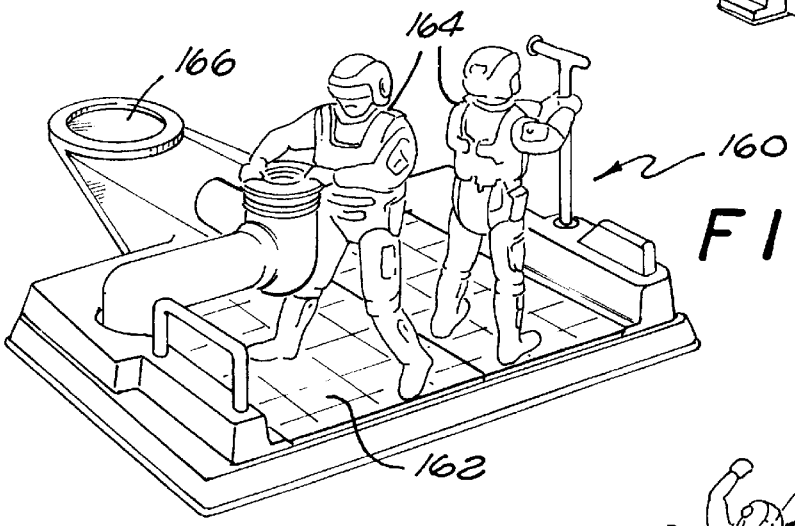
FIG. 10*a* is a perspective view of an alternate embodiment of an action accessory.
Figure 10B:
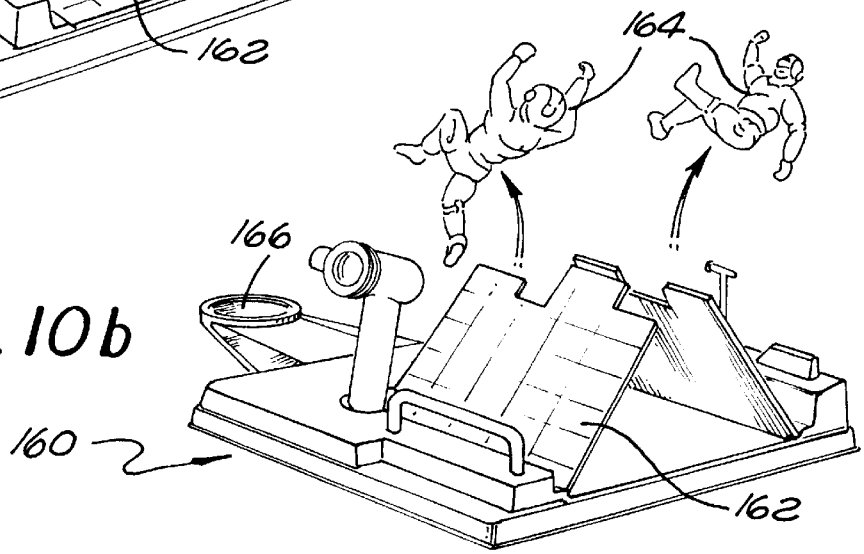
FIG. 10*b* is a perspective view of the action accessory of FIG. 10*a* after a mechanism of the accessory has been activated.

FIGS. 10*a* and 10*b* show an alternate action accessory 160 similar to the accessory 150 shown in FIGS. 9*a* and 9*b*. The accessory 160 contains a platform mechanism 162 that lifts a number of action figures 164 when the trigger 166 is depressed by the plunger 102 of the vehicle 100.

Figure 11A:
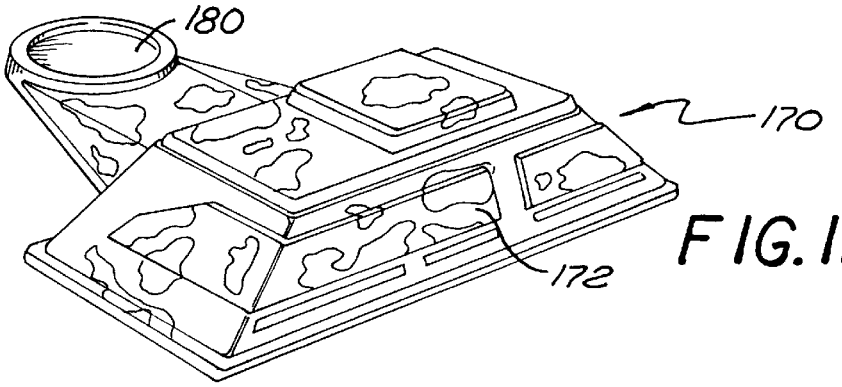
FIG. 11*a* is a perspective view of an alternate embodiment of an action accessory.
Figure 11B:
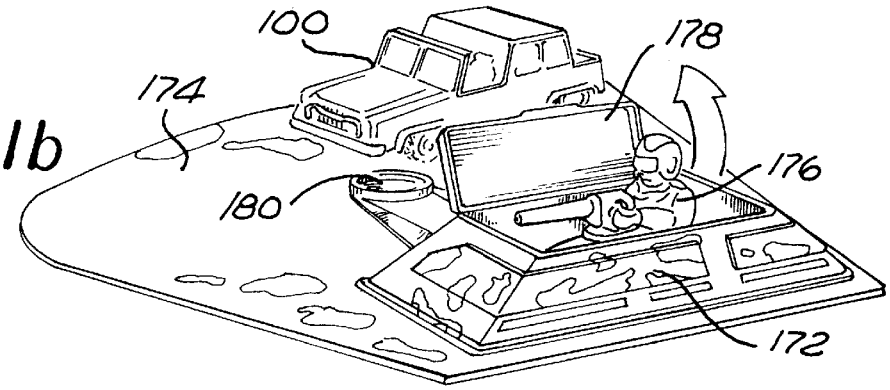
FIG. 11*b* is a perspective view of the action accessory of FIG. 11*a* after a mechanism of the accessory has been activated.

FIGS. 11*a* and 11*b* show an alternate action accessory 170 which contains a toy bunker 172 mounted to a cardboard mat 174. The bunker 172 contains an action figure 176 that is lifted past a rotating lid 178 when the plunger 102 of the vehicle 100 depresses the trigger 180 of the accessory 170.

Figure 12A:
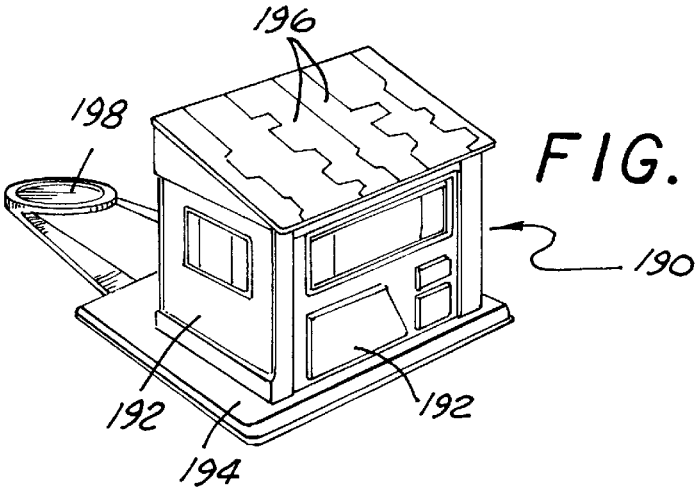
FIG. 12*a* is a perspective view of an alternate embodiment of an action accessory.
Figure 12B:
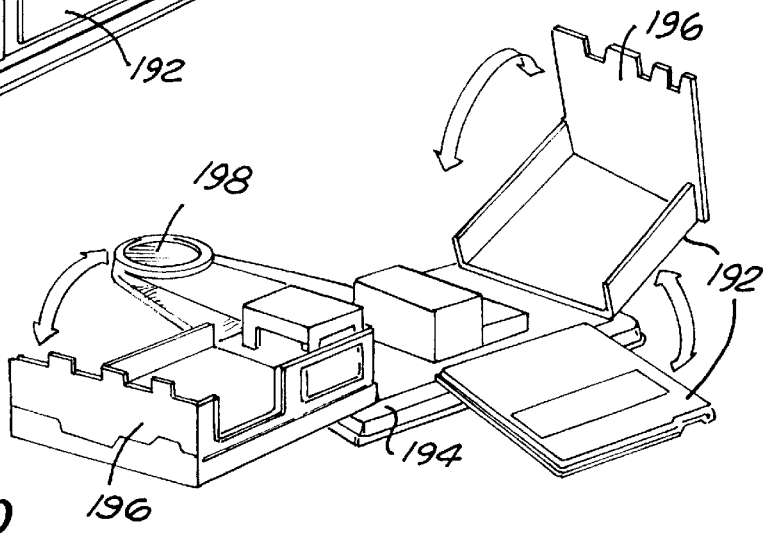
FIG. 12*b* is a perspective view of the action accessory of FIG. 12*a* after a mechanism of the accessory has been activated.

FIGS. 12*a* and 12*b* show an alternate action accessory 190 which has a number of walls 192 that pivot about a base 194. The walls 192 have interlocking roof sections 196 which allow the walls 192 to become detached and rotated to a downward position when the trigger 198 is depressed by the plunger 102 of the vehicle 100. The action accessory 190 provides the appearance of a building that is blowing up as the vehicle is in alignment with the accessory 190.

Figure 13:
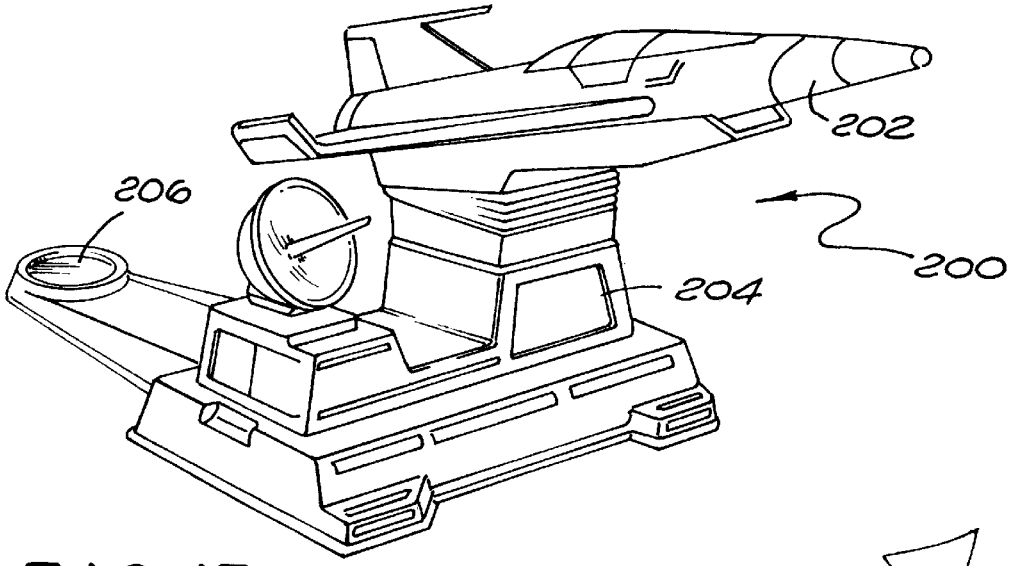
FIG. 13 is a perspective view of an alternate embodiment of an action accessory.

FIG. 13 shows another action accessory 200 which projects a toy airplane 202 from a spring-loaded launcher 204 when the plunger 102 of the vehicle 100 depresses the trigger 206. The toy airplane 202 may be constructed from a light foam material that can be projected a relatively long distance.

Figure 14:
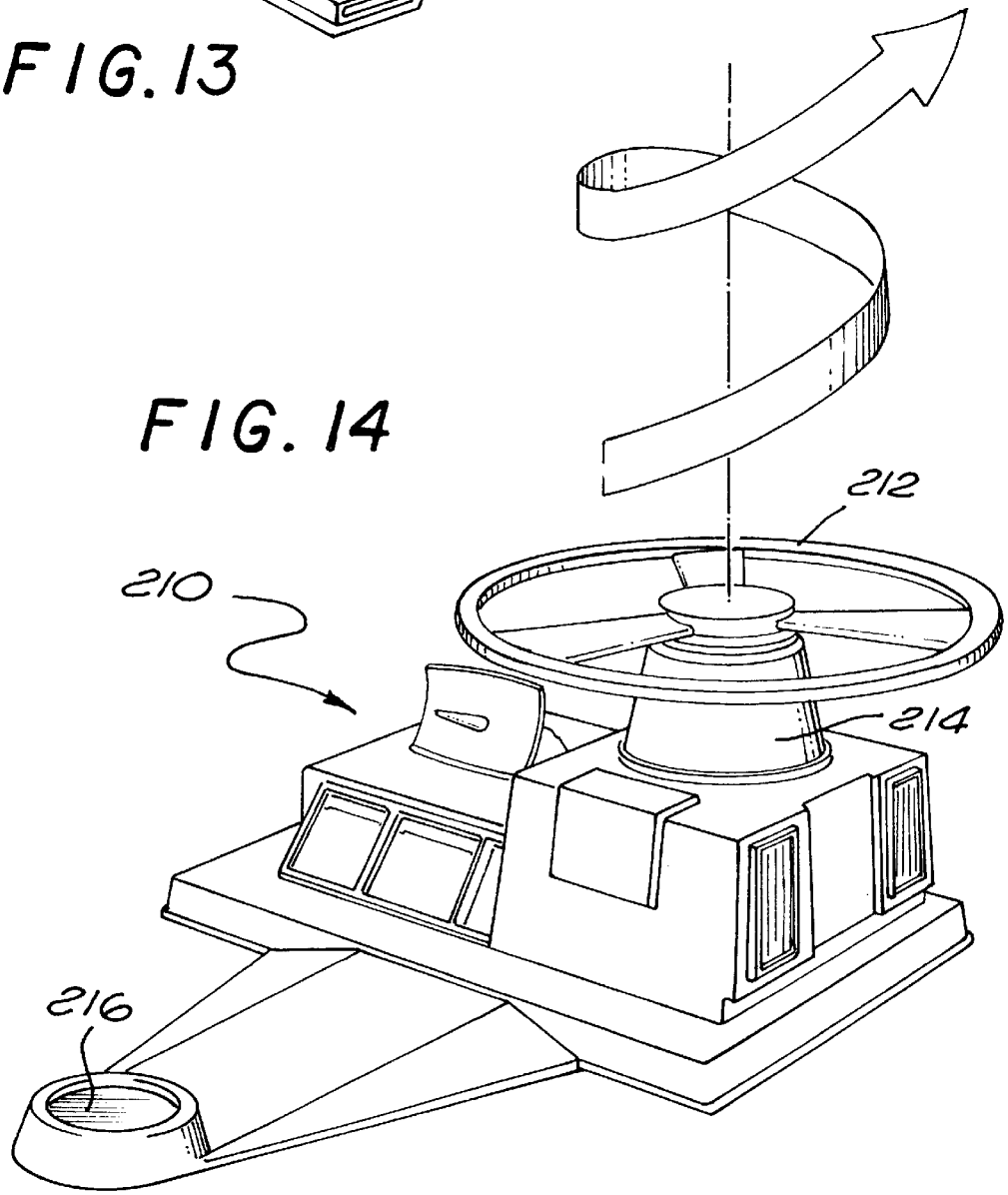
FIG. 14 is a perspective view of an alternate embodiment of an action accessory.

FIG. 14 shows an alternate action accessory 210 which ejects a rotating ring 212 from a launcher 214 when the trigger 216 is depressed by the plunger 102 of the vehicle 100. The action accessory 210 may provide the appearance of a helicopter taking off from a launching pad.

The present invention provides a remote controlled vehicle that mechanically actuates a number of action accessories. Each toy set may have a plurality of action accessories that can be actuated through a relatively inexpensive two or three channel transmitter.

While certain exemplary embodiments have been described and shown in the accompanying drawings, it is to be understood that such embodiments are merely illustrative of and not restrictive on the broad invention, and that this invention not be limited to the specific constructions and arrangements shown and described, since various other modifications may occur to those ordinarily skilled in the art.

What is claimed is:

1. A toy set, comprising:

an action accessory which has a mechanism that is activated by a trigger;

a remote controlled vehicle which has a receiver that receives a plurality of signals and a controller which controls the movement of said vehicle in response to at least one of said signals, said vehicle further having an activator that is activated by at least one of said signals and which engages said trigger to activate said mechanism of said action accessory, said vehicle has a guide that aligns said activator with said trigger; and, a remote transmitter which transmits said signals and allows an end user to selectively activate said activator.

2. The toy set as recited in claim 1, wherein said signals are transmitted by a plurality of radio frequency transmission signals.

3. The toy set as recited in claim 1, wherein said signals are transmitted by a plurality of infrared transmission signals.

4. The toy set as recited in claim 1, wherein said action accessory ejects a projectile when said mechanism is activated by said trigger.

5. The toy set as recited in claim 1, wherein said action accessory emits a stream of fluid when said mechanism is activated by said trigger.

6. The toy set as recited in claim 1, wherein said action accessory includes a platform that releases a toy member when said mechanism is activated by said plunger.

7. The toy set as recited in claim 6, wherein said toy member is an action figure.

8. The toy set as recited in claim 6, wherein said toy member includes a plurality of toy cargo.

9. The toy set as recited in claim 1, wherein said action accessory is a toy building that disengages when said mechanism is activated by said trigger.

10. A method for operating a toy set, comprising the steps of:

a) transmitting a first signal to move a vehicle adjacent to a trigger of a mechanism located within an action accessory;

b) transmitting a second signal to selectively move an activator of said vehicle into engagement with said trigger and activating said mechanism of said action accessory; and, c) loading an object from said action accessory said vehicle when said mechanism is activated.

11. The method as recited in claim 10, further comprising the step of ejecting a projectile from said action accessory when said mechanism is activated.

12. The method as recited in claim 10, further comprising the step of emitting a stream of fluid from said action accessory when said mechanism is activated.

13. A toy set, comprising:

an action accessory which has a mechanism that is activated by a trigger;

a remote controlled vehicle which has a receiver that receives a plurality of signals and a controller which controls the movement of said vehicle in response to at least one of said signals, said vehicle further having an activator that is activated by at least one of said signals and which engages said trigger to activate said mechanism of said action accessory;

a track that guides said vehicle; and, a remote transmitter which transmits said signals and allows an end user to selectively activate said activator.

14. The toy set as recited in claim 13, wherein said vehicle includes a container compartment that cooperates with said action accessory to move said container compartment.

15. The toy set as recited in claim 13, wherein said action accessory loads an object into a toy container of said vehicle when said mechanism is activated by said activator.

16. The toy set as recited in claim 15, further comprising a lever within said track, wherein said lever rotates said toy container and moves said object into a toy bin.

17. The toy set as recited in claim 13, wherein said track has a flexible tab that allows said vehicle to move along said track in a first direction and prevents said vehicle from moving in a second opposite direction, wherein said flexible tab aligns said activator with said trigger.

* * * * *